United States Patent [19]

Wagner

[11] Patent Number: 4,731,035

[45] Date of Patent: Mar. 15, 1988

[54] STEERING MECHANISM FOR OUTBOARD MOTORS

[75] Inventor: William Wagner, West Vancouver, Canada

[73] Assignee: Wagner Engineering Ltd., N. Vancouver, Canada

[21] Appl. No.: 864,084

[22] Filed: May 15, 1986

[51] Int. Cl.[4] ..... B63H 21/26

[52] U.S. Cl. ..... 440/61; 440/53; 440/900; 114/144 R

[58] Field of Search ..... 440/53, 58, 59, 60, 440/61, 63, 900; 114/144 R, 146

[56] References Cited

U.S. PATENT DOCUMENTS

| | | | |
|---|---|---|---|
| 4,041,889 | 8/1977 | Blanchard | 440/60 |
| 4,311,471 | 1/1982 | Queen | 440/63 |
| 4,373,920 | 2/1983 | Hall et al. | 440/59 |
| 4,419,084 | 12/1983 | Borst | 440/63 X |

FOREIGN PATENT DOCUMENTS

| | | | |
|---|---|---|---|
| 190090 | 10/1984 | Japan | 440/63 |

*Primary Examiner*—Sherman D. Basinger
*Assistant Examiner*—Paul E. Salmon
*Attorney, Agent, or Firm*—Thomas A. O'Rourke

[57] ABSTRACT

A steering mechanism is disclosed for a boat equipped with an outboard motor. The steering mechanism has a pair of opposed single acting cylinders maintained in a spaced relationship by a frame member. A pair of brackets enable pivotal connection of the steering mechanism with the mounting bracket of the motor. A piston is received in and extends between the cylinders and carries a lost motion linkage connectable with the tiller arm of the motor to induce steering movement of the motor upon actuation of the piston.

8 Claims, 10 Drawing Figures

STEERING MECHANISM FOR OUTBOARD MOTORS

BACKGROUND OF THE INVENTION

This invention relates to steering mechanisms for vehicles and particularly to steering mechanisms of aquatic crafts.

Steering mechanisms are generally available for boats employing outboard motors. These mechanisms are equipped with a hydraulic motor connected to the tiller arm of the outboard motor and are actuated by a valve or pump which is coupled with the steering wheel. Such mechanisms are generally available in two forms, each employing a hydraulic motor with double acting cylinder henceforth referred to as a double acting motor. In one prior art system, the cylinder is mounted to the tiller arm with the piston being coupled through a linkage to the mounting bracket. In another system, the piston is fixed relative to the tiller arm while the cylinder is coupled via a linkage to the mounting bracket.

Steering is achieved by supplying fluid under pressure to the appropriate side of the piston which induces rotation of the outboard motor about its steering axis relative to a mounting bracket. Rotation of the outboard motor also causes the double acting motor to rotate relative to the mounting bracket and thus has several shortcomings.

Firstly, all hoses and couplings providing fluid under pressure to the cylinder must move with the double acting motor thereby increasing wear and consequently reducing operating life. Rotation of the double acting motor can also cause inadvertent contact with an unattentive occupant or with objects such as paddles and skis thereby causing personal injury or damage to the mechanism. This problem is compounded as the use of a double acting motor requires the use of a piston which passes through each end of the cylinder and projects laterally across the stern. The use of a double acting motor requires a seal at each end of the cylinder and a seal between the piston and cylinder wall to define the inner chambers. Because the ends of the piston are offset from the tiller arm, a linkage is required at one or both ends of the piston. Consequently, the normal forces required to turn the outboard motor often result in large bending moments in the piston which are reacted at the seals thereby reducing their operating life.

SUMMARY OF THE INVENTION

It is therefore an object of the present invention to obviate or mitigate the above-mentioned disadvantages.

Briefly stated, the invention comprises a steering mechanism for an outboard motor rotatable about a steering axis by a tiller arm and tiltable about a tilt axis relative to a mounting bracket. The steering mechanism has a pair of opposed single acting cylinders maintained in spaced relationship along a common axis by a frame member. A pair of brackets connect the cylinders to the motor and extend transverse to the common axis. The brackets terminate in connection means for pivotally connecting the mechanism to the outboard motor on the tilt axis whilst restraining the mechanism from rotation about the steering axis. A piston is received in and extends between the cylinders. Mounted on the piston is a lost motion linkage for movement therewith and connectable to the tiller arm to induce steering movement of the motor upon actuation of the piston.

THE DRAWINGS

Further objects, features and advantages of the present invention will be evident from the following detailed description of several preferred embodiments given by way of example only and illustrated in the appended drawings in which.

GENERAL DESCRIPTION

Figure 1:
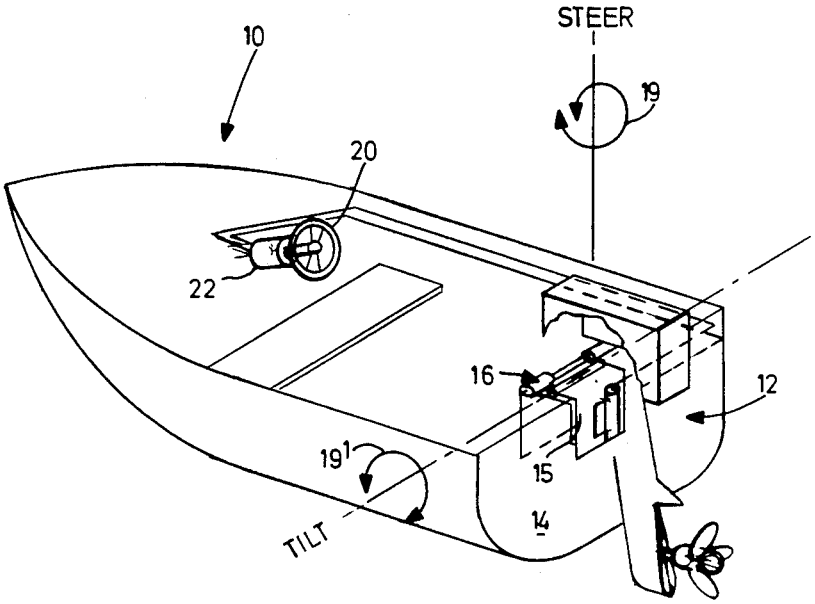
FIG. 1 is a perspective view of a boat equipped with a steering mechanism.
Figure 2:
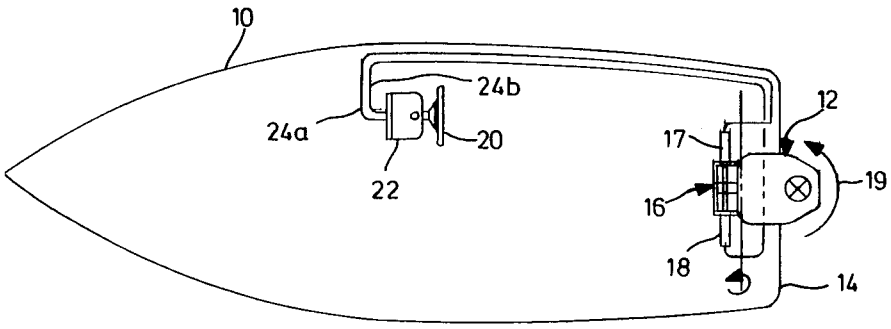
FIG. 2 is a schematic plan view of a boat shown in FIG. 1.

Referring to FIGS. 1 and 2, a boat 10 is provided with outboard motor 12 which is mounted on transom 14 by means of mounting bracket 15 and is rotatable about a steering axis identified by arrow 19 and a tiltable about a tilt axis identified by arrow 19'. The boat is maneuvered by a steering mechanism 16 which is connected to mounting bracket 15.

Steering mechanism 16 has a pair of opposed single acting rams 17 and 18 which are controlled by a steering wheel 20 connected to the shaft of a helm pump 22 and located in the front of boat 10. Joining the outlets of helm pump 22 and rams 17 and 18 respectively are hydraulic lines **24*a* and 24*b***.

Figure 3:
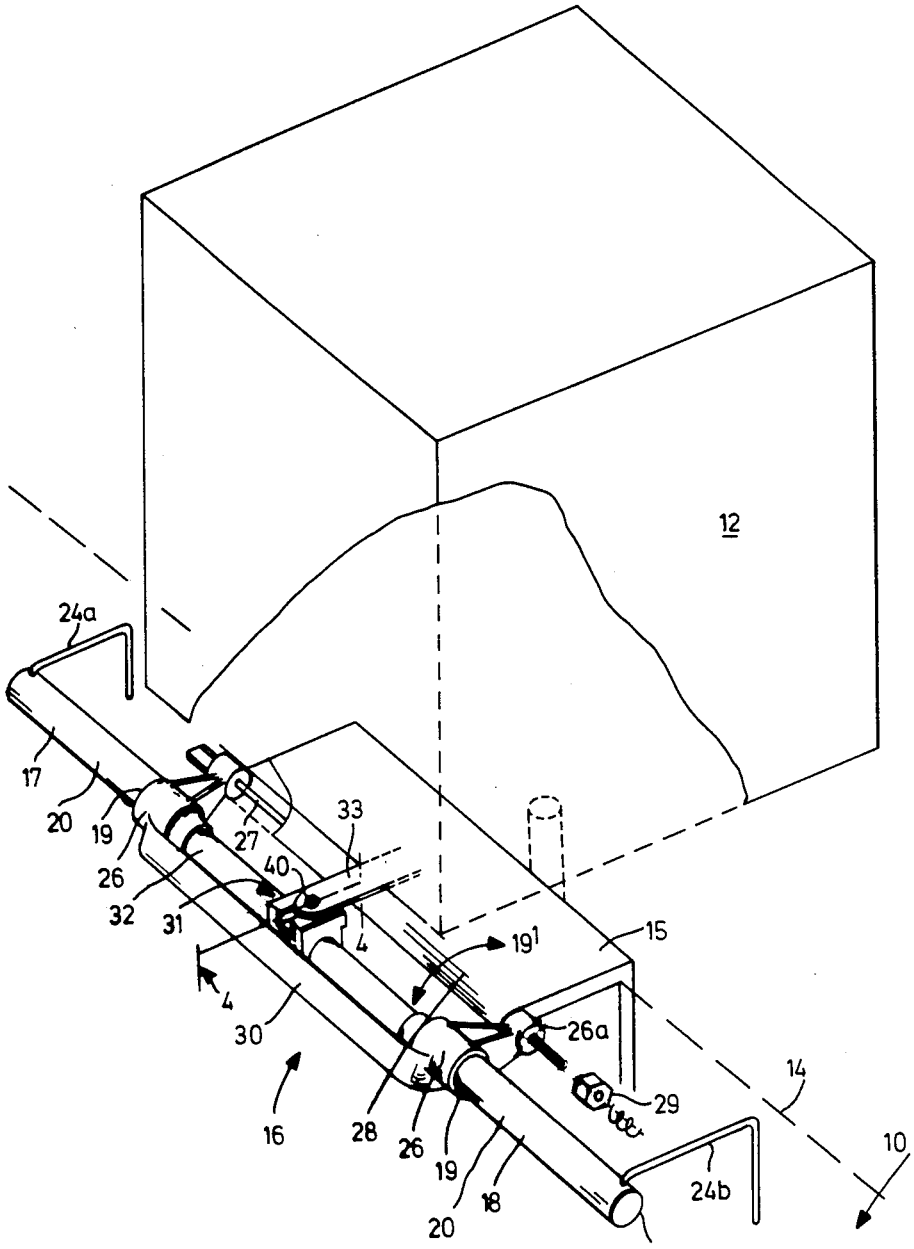
FIG. 3 is a perspective view on an enlarged scale of the steering mechanism shown in FIG. 1.
Figure 5:
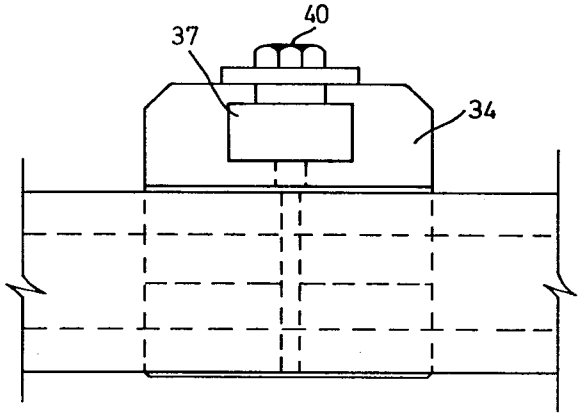
FIG. 5 is a view in the direction of arrow 5 in FIG. 4.

Referring to FIG. 3, steering mechanism 16 is pivotally mounted by means of bores **26*a* formed in the ends of brackets 26. Threaded rod 27 is inserted through bores 26*a* and tilt tube 28 and held in position by nuts 29. Tilt tube 28, is formed in the upper end of mounting bracket 15 and defines tilt axis 19' between bracket 15 and outboard motor 12 to permit the motor to be positioned out of the water for storage when not being used. Brackets 26 are joined together by elongate member 30 and constitute a unitary cast frame which maintains the cylinders 20 of rams 17 and 18 in spaced relationship. The cylinders 20, are received in bores 19 in the brackets 26 so that the cylinders are coaxial. An elongate piston 32 is received in and extends between cylinders 20** to move along a common axis.

Connected between piston 32 and the tiller arm 33 of outboard motor 12 is a lost motion linkage 31.

Figure 4:
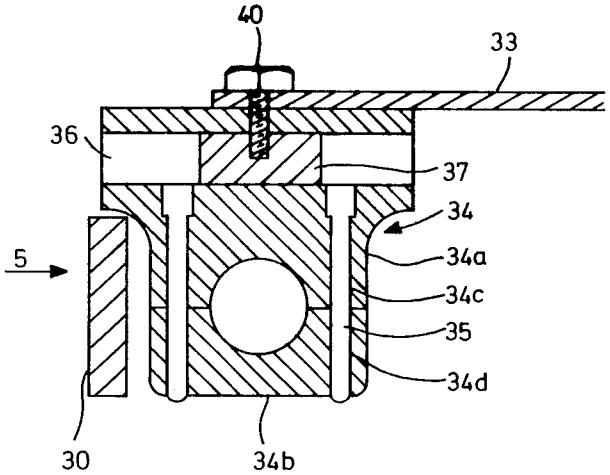
FIG. 4 is a cross-sectional view taken on the line 4—4 in FIG. 3.

The lost motion linkage 31 is shown in more detail in FIG. 4 and includes a composite block 34. The block 34 is formed from a base number **34*a* and a clamp member 34*b*. The base number 34*a* has a pair of bores 34*c* which are respectively in alignment with a pair of threaded bores 34*d* in clamp member 34*b*. The corresponding bores 34*c* and 34*d* receive bolts 35 which establish a clamping arrangement between base member 34*a* and clamp member 34*b*. Each of the base member 34*a* and clamp member 34*b* have respective surfaces 34*e* and 34*f*** with cylindrical recesses 34e' and 34f'. These recesses cooperate to form a cylindrical passage to receive and clamp the piston 32. Formed in the upper portion of base member 34a is channel 36 having a central axis transverse to the common axis. A slider 37 is slidably engaged with channel 36 and is restrained for reciprocal displacement along the axis of channel 36. Tiller arm 33 is pivotally connected with slider 37 by means of fastener 40.

Advantages of the steering mechanism will become evident when considering the operation of the steering mechanism and its movement relative to the mount during the maneuvering procedure. Upon rotation of the steering wheel 20, a pressure differential is established in the hydraulic lines 24a and 24b by the helm pump 22 so that one line is at a higher pressure than the other. As a result a force is generated to move the piston 32 along the axis.

The displacement of the piston 32 causes the block 34 to move relative to the elongate member 30 and to direct the force through the walls of the channel to the slider, which in turn directs the force to the tiller arm 33 via the fastener 40.

In response the tiller arm 33 is displaced in conjunction with the block 34, causing the outboard motor 12 to rotate about its steering axis, the degree of rotation being commensurate with the displacement of the pivot point. Rotation of the outboard motor 12 also causes displacement of the slider 37 along the channel 36 relative to the block.

Thus, steering movement is achieved by pressurization of either of the rams 17 and 18 which remain stationary with respect to the mounting bracket 15. Moreover, the steering mechanism remains in a fixed position regardless of the rotational orientation of the outboard motor 12 about its steering axis. This eliminates the possibility of inadvertent contact between the steering mechanism and other objects such as paddles and skis or arms and legs.

The pivotal connection of the steering mechanism 16 to the tilt tube 28 via rod 27 enables the motor and steering mechanism 16 to be rotated about tilt axis 19', for storage or to ride over obstacles. As well, the stationary orientation of the steering mechanism 16 relative to the mounting bracket 15 and the steering axis 19 diminishes the need of slack normally required in the hydraulic lines 24a and 24b to allow for rotation during steering. This results in another safety feature by substantially eliminating the chance of entanglement of the operator or other objects in the hydraulic lines 24a and 24b and causing injury or further damage. Instead, the hydraulic lines may be neatly attached to the side wall and transom 14 of the boat, without further concern of abrasive wear and fatigue normally present with steering mechanisms which rotate about the steering axis.

A still further feature of the steering mechanism is that the central location of the piston rod 32 between the cylinders 20 and the elongate member 30 substantially reduces the bending moment usually seen in the conventional offset piston rod during the steering motion and thereby increases the operating life of the steering mechanism 16. This reduction in bending moment also enables a reduction in fabrication cost since the piston rod 32 may be formed from a tubular member as opposed to the conventional solid rod type. As well, the seals in each of the cylinders 20 need not withstand the uneven pressures generated by the moment arm and thereby need not meet the normally relatively high design criteria. Accordingly, the central orientation of the piston rod 32 permits a more basic and inexpensive construction of the steering mechanism 16 while increasing operating life.

Figure 6:
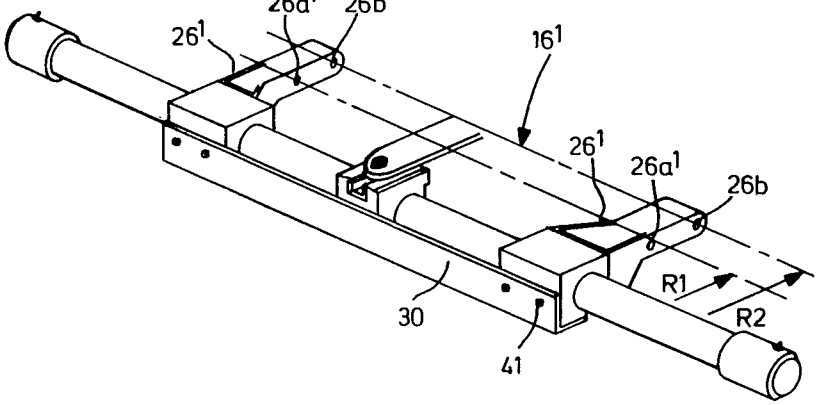
FIG. 6 is a perspective view of a second embodiment of the steering mechanism.

In another embodiment, the steering mechanism is adjustable for outboard motors having different pivotal distances between the tiller arm 33 and the tilt tube 28. As can be seen in FIG. 6, the steering mechanism 16' has brackets 26', each having a pair of circular bores 26a' and 26b. Bores 26a' and 26b on one of the brackets 26' are respectively coaxial with bores 26a' and 26b on the other, thereby enabling a selection from two possible pivotal radii $R_1$, $R_2$ for location of rod 27, for pivotal connection with tilt tube 28. Brackets 26' may include more circular bores if desired, depending on the design variations of the outboard motors under consideration. As well, brackets 26' may be fastened to elongate member 30' by means of fasteners 41, as is shown in FIG. 6.

Figure 7:
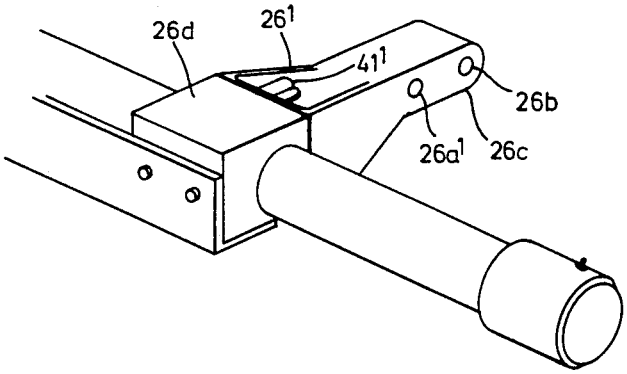
FIG. 7 is a perspective view of a third embodiment of the steering mechanism.

As is shown in FIG. 7, brackets 26' may also comprise two components, namely a bracket arm 26c and a bracket base 26d to which the bracket arm 26c is removably conected by means of bolts 41'.

Figure 8:
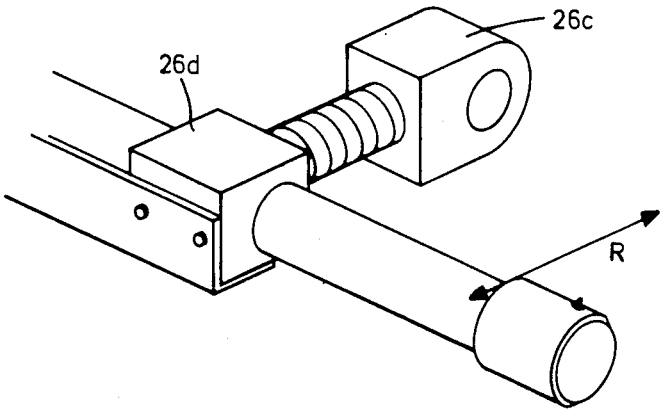
FIG. 8 is a perspective view of a fourth embodiment of the steering mechanism.

A further alternative is shown in FIG. 8 wherein the bracket arms 26c are threadably engaged with bracket base 26d so as to provide fine adjustment of the pivotal radius, R, of brackets 26.

Figure 9:
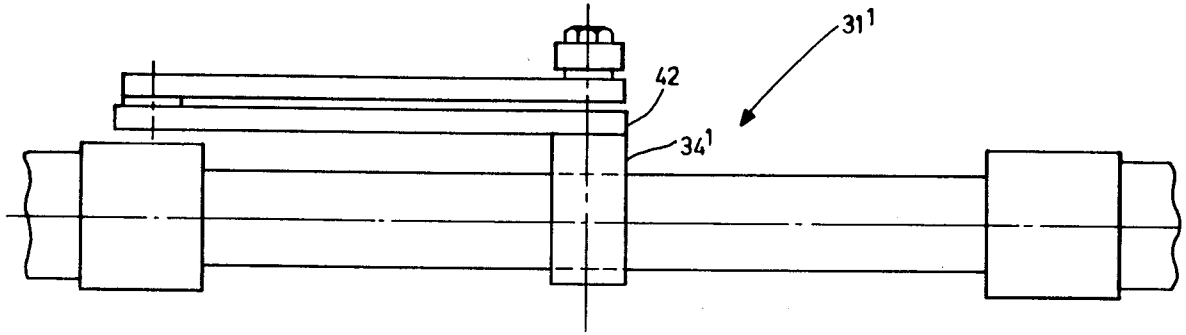
FIG. 9 is a side view of a fifth embodiment of the steering mechanism.
Figure 10:
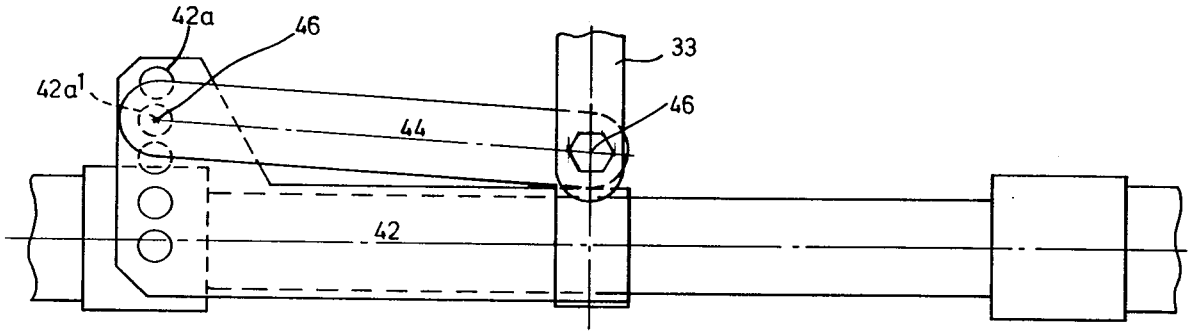
FIG. 10 is a plan view of the embodiment shown in FIG. 9.

Variations of the lost motion linkage 31 to provide further adaptations of the steering 16 are also contemplated including the embodiment shown in FIGS. 9 and 10. A lost motion linkage 31' utilizes a double arm assembly, in lieu of the channel 36 and the slider 37, wherein the first arm 42 is secured at one end to block 34'. The opposite end of first arm 42 is pivotally connected to second arm 44 by means of pivot pin 46 in one of bores 42a. The bores 42a are oriented transverse to the common axis and provide a selection of different pivot points depending on the relative dimensions between the tilt tube 28 and the tiller arm 33 of a particular motor. The second arm 44 is also pivotally connected to the tiller arm 33 by means of fastener 47.

It should be noted that in all cases, rotation of the lost motion linkage 31 is possible only in the plane of the steering axis 19, since rotation of block 34 about the common axis is prevented by the planar integrity of the linkages. Furthermore, the fit between block 34 and piston rod permits rotation of steering mechanism about tilt axis 19' when the outboard motor is tilted.

I claim:

1. A steering mechanism for an outboard motor rotatable about a steering axis by a tiller arm and tiltable about a tilt tube defining a tilt axis relative to a mounting bracket, said steering mechanism comprising:

a pair of opposed single acting cylinders maintained in spaced relationship along a common axis by an elongate frame member, a pair of brackets to connect said cylinders to said motor, said brackets holding each of said cylinders near one end thereof, and extending transverse to said common axis, said brackets terminating at connection means to pivotally connect said mechanism to said tilt tube, the ends of said elongate member joining said brackets, said connection means including a plurality of bores formed in each of said brackets, the axis of each of said bores lying in the same plane, each of said bores in one of said brackets being coaxial with a respective bore in the other of said brackets, so as to receive a rod member upon said pivotal connection with said tilt tube, a piston rod received in and extending between said cylinders, and a lost motion linkage connected to the central region of said piston rod for movement therewith and connectable to a tiller arm to induce steering movement of said motor upon actuation of said piston rod.

2. A steering mechanism as defined in claim 1 wherein each of said brackets includes adjustment means associated with said connection means to adjust a pivotal radius of said mechanism.

3. A steering mechanism as defined in claim 2 wherein said connection means includes an arm having a bore transversely formed therein, a portion of said arm being threaded for threaded engagement with a base portion so as to define said adjustment means.

4. A steering mechanism as defined in claim 1 wherein said elongate member is spaced transverse to said piston rod, said lost motion linkage further comprises a block fixed to said piston rod, said block having a central bore through which said piston rod passes, one side of said block being adjacent said elongate member.

5. A steering mechanism as defined in claim 4, further comprising a channel, formed on the upper surface of said block, said channel having a central axis transverse to said common axis, a slider located in said channel for slidable displacement along said channel, a portion of said slider being exposed to the exterior of said block.

6. A steering mechanism as defined in claim 5 wherein said slider is connectable with said tiller arm by means of a pivot pin for translating the linear displacement of said block and said slider into the rotational displacement of said motor about said steering axis, whilst restraining said lost motion linkage from rotation about said common axis.

7. A steering mechanism as defined in claim 4 wherein said lost motion linkage includes a first pivot member secured at one end to said block, the other end of said pivot member having defined therein, a plurality of passages, a second pivot member having a first passage located near one end thereof and pivotally connectable with said first pivot member by means of a first pivot pin to be selectively inserted in one of said plurality of passages, said second pivot member being pivotally connectable with said tiller arm.

8. A steering mechanism as defined in claim 7 wherein said second pivot member has a second passage located near the other end thereof for pivotal connection by means of a second pivot pin to said tiller arm, said tiller arm having a passage for the insertion of said second pivot pin.

* * * * *